United States Patent [19]

Barker

[11] 4,019,167

[45] Apr. 19, 1977

[54] ENCAPSULATED TRANSFORMER

[75] Inventor: Kenneth L. Barker, Flanders, N.J.

[73] Assignee: Amerace Corporation, New York, N.Y.

[22] Filed: May 19, 1975

[21] Appl. No.: 579,117

[52] U.S. Cl. ..... 336/96; 336/100; 336/107; 339/253 R

[51] Int. Cl.[2] ..... H01F 15/10; H01F 27/04

[58] Field of Search ..... 336/96, 100, 107; 174/52 PE; 339/253 R, 253 S, 253 L, 255 R, 255 A, 60 R, 60 M, 14 R

[56] References Cited

UNITED STATES PATENTS

| | | | |
|---|---|---|---|
| 1,132,297 | 3/1915 | Apple | 336/107 X |
| 1,339,100 | 5/1920 | Cavanagh | 336/107 X |
| 2,159,150 | 5/1939 | Heintz | 339/253 S X |
| 2,382,199 | 8/1945 | Brink | 174/52 PE |
| 2,428,214 | 9/1947 | Gorey | 339/255 R X |
| 2,743,308 | 4/1956 | Bardsley | 336/96 X |
| 3,166,371 | 1/1965 | Brown et al. | 339/60 R |
| 3,179,915 | 4/1965 | Klassen | 339/255 R X |
| 3,210,701 | 10/1965 | Fostner et al. | 336/96 |
| 3,448,423 | 6/1969 | Minks | 336/96 |
| 3,739,317 | 6/1973 | Wise | 339/255 R X |
| 3,824,524 | 7/1974 | Glover | 339/60 R |
| 3,909,759 | 9/1975 | Ouellette et al. | 336/96 X |

FOREIGN PATENTS OR APPLICATIONS

| | | | |
|---|---|---|---|
| 586,661 | 0000 | Canada | 336/96 |

*Primary Examiner*—Thomas J. Kozma
*Attorney, Agent, or Firm*—S. Michael Bender; Ken Richardson; Richard A. Craig

[57] ABSTRACT

An encapsulated transformer in which the coil and core assembly of the transformer is encapsulated within a jacket of non-flexible epoxy resin, and a cushion of closed-cell foam rubber lies between the jacket and the coil and core assembly to preserve the integrity of the jacket while enabling thermal expansion and contraction of the core and coil assembly. Electrical contact members are integral with the jacket and are electrically connected to the core and coil assembly by flexible electrical leads.

13 Claims, 6 Drawing Figures

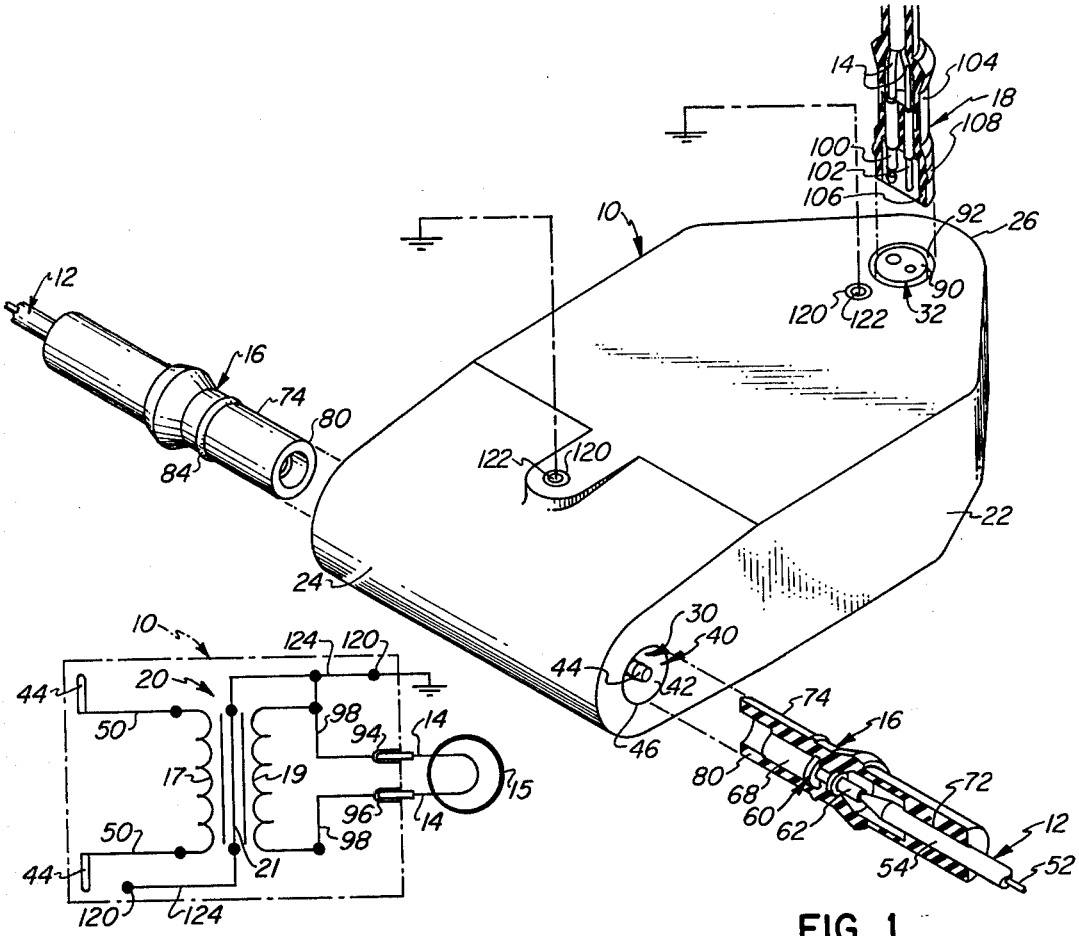
FIG. 1
FIG. 2
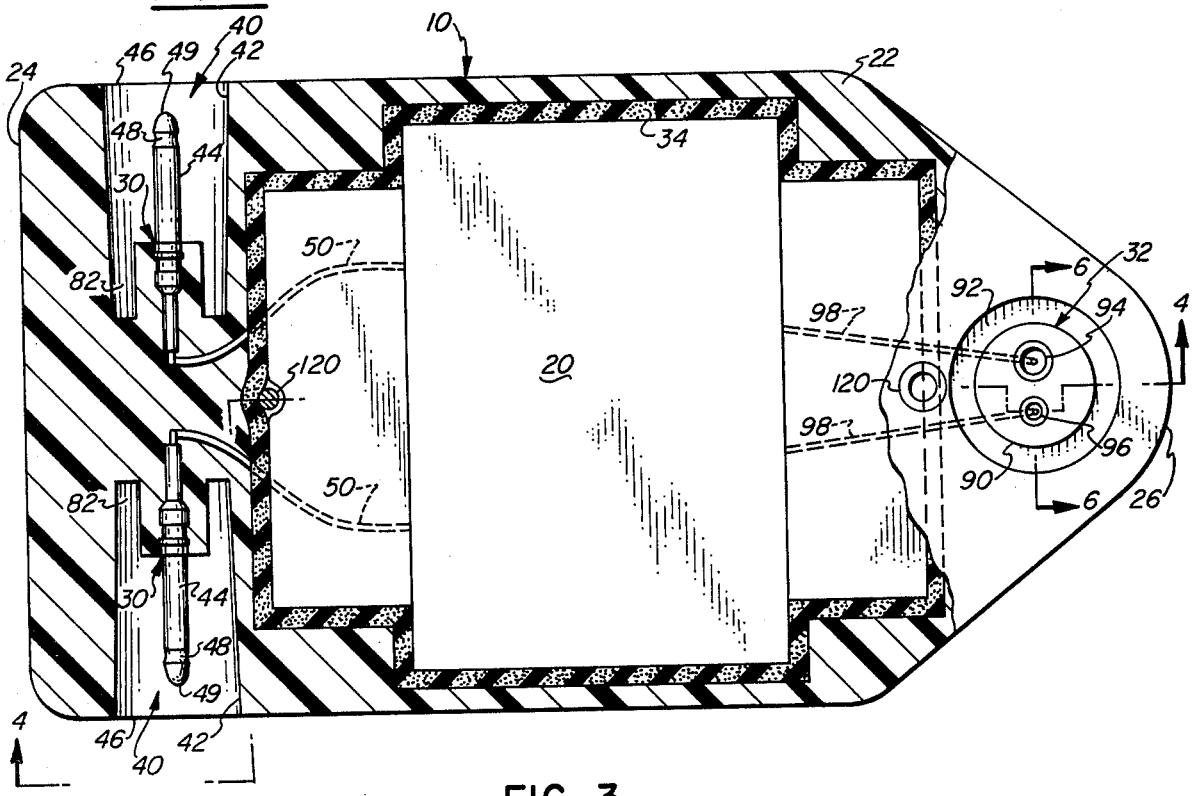
FIG. 3

ENCAPSULATED TRANSFORMER

The present invention relates generally to transformers and pertains, more specifically, to encapsulated transformers of the type having integral electrical connector elements and employed in installations requiring direct burial in the ground.

One such installation is in airfield runway lighting systems which aid aircraft pilots in operations at night or during periods of poor visibility. The various types of lighting systems now in use employ either a constant voltage or a constant current circuit. The type employing a constant current series circuit is the newer and more generally accepted system and exhibits the advantages of a constant current in the feeder cable, the requirement for only one cable loop in the series circuit, and the maintenance of a constant current through all of the lamps in the system, enabling the lamps to exhibit equal brightness.

Major disadvantages of early series circuits were the inability to maintain circuit continuity upon lamp failure and the extra precautions needed to protect personnel and equipment from high open-circuit voltage. Introduction of isolating transformers in the series loop has improved the service reliability of the system and reduced the danger to maintenance crews from high voltage.

Isolating transformers for airport runway series lighting circuits have been in use in North America for more than two decades. These transformers generally are encapsulated in rubber and have a history of good performance and long service life. Over the years, new materials and new components, such as cables, regulators, control equipment and light fixtures have been developed and introduced. The need has arisen for an improved isolating transformer to match the improvements in other components of the lighting system.

It is therefore an object of the present invention to provide an encapsulated transformer in which the encapsulating material exhibits an advantageous combination of properties which facilitates the manufacture, installation and performance of the transformer, the encapsulating material providing maximum resistance to damage and deterioration due to ambient influences.

Another object of the invention is to provide an encapsulated transformer having a watertight construction suitable for direct burial and which remains watertight under a wide range of temperature variation.

Still another object of the invention is to provide an encapsulated transformer having an outer watertight jacket which includes integral electrical connector elements and which remains watertight even when the connector elements are not connected to complementary components and are exposed directly to water.

A further object of the invention is to provide an encapsulated transformer having an outer jacket which resists rough handling and which includes integral electrical connector elements having a recessed construction which resists damage during rough handling.

A still further object of the invention is to provide an encapsulated transformer having a rugged construction which includes means for accommodating temperature variations without fracture of the encapsulating structure or disconnection of electrical connections, either within or without the encapsulating structure.

Another object of the invention is to provide an encapsulated transformer which is compatible with other components employed in airfield lighting systems.

A further object of the invention is to provide an encapsulated transformer of relatively simple design and construction and which is economical to manufacture.

The above objects, as well as still further objects and advantages, are attained by the present invention which may be described briefly as an encapsulated transformer for use in varying ambient conditions which can include a relatively wide range of temperature and immersion in water, the transformer comprising a transformer core and coil assembly including primary and secondary windings, a jacket of non-flexible, dielectric synthetic resin material, such as a thermosetting epoxy resin, surrounding the core and coil assembly, a cushion of resilient material, such as a closed-cell foam rubber, between the jacket and the core and coil assembly, electrical connector elements including portions unitary with the jacket and electrical contact members integral with the jacket, and flexible electrical leads connecting each contact member with a respective winding in the core and coil assembly, whereby the integrity of the jacket is maintained while thermal expansion and contraction of the core and coil assembly is permitted without a corresponding expansion and contraction of the jacket.

The invention will be more fully understood, while still further objects and advantages thereof will become apparent, by reference to the following detailed description of an embodiment of the invention illustrated in the accompanying drawing, in which:

FIG. 1 is a perspective view of an encapsulated transformer constructed in accordance with the invention and being connected into an airport lighting circuit;

FIG. 2 is a schematic view of the encapsulated transformer;

FIG. 3 is a plan view of the encapsulated transformer, cut away to illustrate the inner construction thereof;

Figure 4:
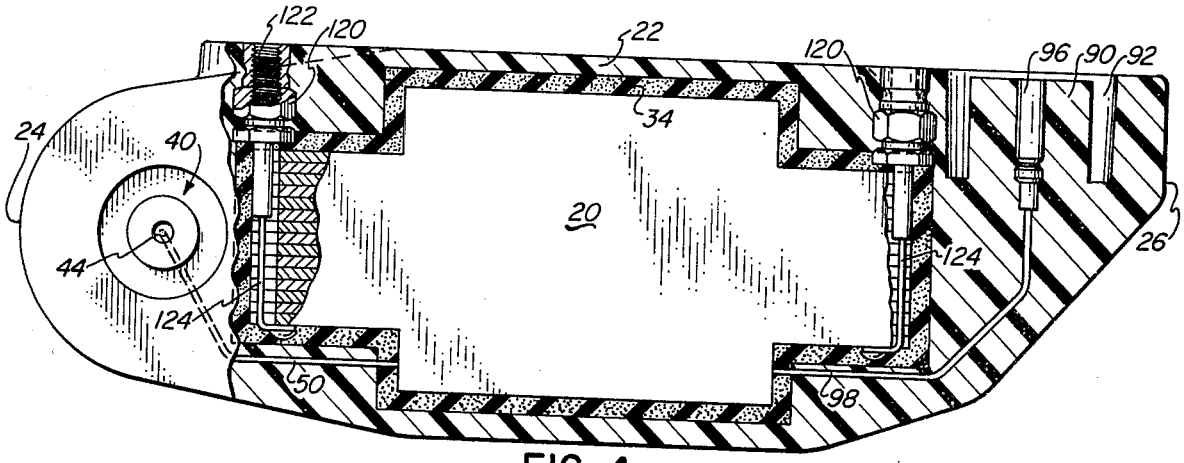
FIG. 4 is a cross-sectional view taken along line 4—4 of FIG. 3.

Referring now to the drawing, and especially to FIGS. 1 and 2 thereof, an encapsulated transformer constructed in accordance with the invention is illustrated generally at 10 and is seen being connected into an airfield lighting circuit which includes a cable loop having cable 12, and a pair of conductors 14 connected to a lamp 15. Cable 12 is to be connected, in series, with the primary windings 17 of the transformer, while conductors 14 are to be connected across the secondary windings 19 of the transformer. The primary connections are to be made by means of a single-conductor connector in the form of plug 16 affixed at terminal ends of cable 12 and the secondary connections are to be made by means of a two-conductor connector in the form of receptacle 18 affixed at terminal ends of conductors 14, all as will be explained in greater detail below.

Turning to FIGS. 3 and 4, as well as to FIG. 2, encapsulated transformer 10 has a core and coil assembly 20, which includes a metallic laminated core 21 and the conventional primary and secondary windings 17 and 19. An outer jacket 22 of encapsulating material surrounds and envelopes the assembly 20 and extends longitudinally between opposite ends 24 and 26, beyond the corresponding ends of assembly 20 to provide integral electrical connector elements 30 and 32 adjacent the opposite ends 24 and 26, respectively.

Jacket 22 is molded of a non-flexible synthetic resin material to establish a unitary construction which includes portions of the connector elements 30 and 32. The material of jacket 22 must be chosen carefully so as to provide transformer 10 with the desired physical, chemical and electrical properties for ease of manufacture and for satisfactory performance. Among the more important physical properties are the non-flexible property of jacket 22, linear and volumetric expansion characteristics in jakcet 22 related to those of the core and coil assembly 20, suitably low viscosity of the jacket material at pouring temperature during the molding operation, a maximum exotherm temperature of the jacket material lower than that which will cause deleterious heat distortion of the coil wire insulation, the ability to withstand temperatures in the range of about −45° C to 120° C during service without embrittlement or softening of jacket 22, the ability to withstand a free fall of about four feet to a concrete floor without fracturing or chipping jacket 22, a watertight encapsulation with or without connection of connectors such as plug 16 and receptacle 18, and the ability to operate properly under at least a six foot head of water.

Among the more important chemical properties are resistance to saturated ground acids and alkalis, salt, urea and all mineral oils, especially those found at airfields. The material should be non-flammable, non-edible by rodents or insects, and not deleteriously affected by ozone and ultra-violet radiation. From an electrical standpoint, the encapsulating structure should absorb only a maximum of about 0.1% by weight of water, should have a minimum insulation resistance of about 15,000 megohms at 15 kV DC, should have a dielectric strength of at least 400 volts/-mil, a dielectric constant of about 4.1 at room temperature, and must be non-tracking.

A suitable material for jacket 22 which exhibits the desired properties and characteristics in transformer 10 is a thermosetting dielectric epoxy resin mixture formulated as follows:

| Component | Parts by Weight |
|---|---|
| Resin | 80 |
| Flexibilizer | 20 |
| Cure Agent | 18 |
| Milled Glass Fiber | 20 |
| Silica Flour | 50 |

The resin, flexibilizer and cure agent are available commercially from Shell Chemical Company under the following descriptions:

| Component | Description |
|---|---|
| Resin | No. 828 Unmodified Bisphenol "A" |
| Flexibilizer | No. 871 Aliphatic Epoxy Resin |

-continued

| Component | Description |
|---|---|
| Cure Agent | Z Modified Polyamine |

The milled glass fiber is No. 701 × 1/32 inch.

In order to accommodate any differences in the amounts of thermal expansion and contraction experienced by the core and coil assembly 20 and jacket 22, especially after installation of the transformer 10, over the above-specified range of temperatures and thereby to preclude cracking of the jacket or any related failure which could have a deleterious effect on the transformer, a cushion 34 of resilient material is provided between the core and coil assembly 20 and the jacket 22. Preferably, cushion 34 surrounds assembly 20 and is coextensive with the interior of jacket 22. A suitable material for cushion 34 is a closed-cell foam rubber.

Referring now to FIGS. 1 through 5, electrical connector elements 30 are in the form of receptacles 40 each of which includes a recess 42 in the jacket 22 and an electrical contact member in the form of pin 44 embedded in the material of jacket 22, as by molding the jacket around the pin, so that each pin 44 is integral with the jacket 22. Pin 44 projects outwardly toward the opening 46 to recess 42, but does not extend beyond opening 46 so that the pin is protected, by virtue of being fully within recess 42, from external blows which might otherwise reach the pin. Each pin has an annular groove 48 adjacent the tip end 49 thereof, for purposes which will be explained below. A pair of flexible leads 50 connect the pins 44 to the primary coil of the core and coil assembly 20.

Cable 12 includes a conductor 52 surrounded by insulation 54 which is skived at each terminal end to expose a length 56 of conductor 52. Each plug 16 includes an electrical contact 60 having a ferrule 62 for receiving length 56 of conductor 52. Contact 60 is permanently affixed to conductor 52 by crimping the ferrule 62. Contact 60 includes a socket 64 which is generally complementary to pin 44 of the connector elements 30 and is split into a plurality of segments 66. Resilient means in the form of a flexible band 68 surrounds the segments 66 and biases the segments inwardly toward one another. A sleeve 70 of dielectric elastomeric material is fitted over contact 60 and the terminal end of cable 12 and establishes a watertight seal along the interface 72 between the sleeve 70 and insulation 54 of the cable. Sleeve 70 includes a cylindrical plug portion 74 having an outside diameter generally complementary to the inside diameter of receptacle 40 such that plug portion 74 can be received within the recess 42 of receptacle 40.

Upon insertion of plug portion 74 into recess 42, pin 44 will enter socket 64, with segments 66 being resiliently urged into good electrical contact with the pin. Once the plug portion 74 is fully inserted into recess 42, capturing means including a detent element in the form of locking ball 76, which is biased against seat 78 by band 68 and projects into socket 64, engages annular groove 48 in pin 44 to secure the connection, as illustrated in the lower left-hand portion of FIG. 5. The electrical connection between pin 44 and socket 64 is sealed against dirt, water and other deleterious foreign matter by the seating of skirt 80 or sleeve 70 within the complementary annular channel 82 in recess 42 and by the resilient deformation of an annular bead 84 of plug portion 74 upon insertion of the bead 84 into recess 42. Because of the non-flexible nature of the material of jacket 22 and minimal thermal expansion and contraction of the material, the dimensional relationships between the plug portion 74 and recess 42 tend to remain unchanged during service, thereby preserving the integrity of the seals and the connections. The detent locking arrangement provided by ball 76 and groove 48 enables the connection between cables 12 and the connector elements 30 to withstand pulling forces during installation and during operation which otherwise would tend to open the connection. Such pulling forces arise by direct pulls on the cables during installation or during operation through shifting of the transformer or cables, or both, by a variation in temperature or the shifting of the ground in which the installation is buried. A minimum pulling force of seventeen pounds is easily accommodated by the above-described arrangment.

Figure 6:
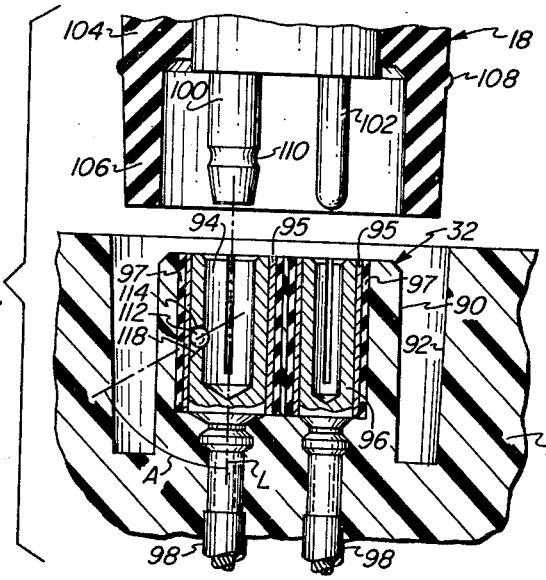
FIG. 6 is an enlarged fragmentary cross-sectional view taken along line 6—6 of FIG. 3, illustrating secondary connector elements.
Figure 5:
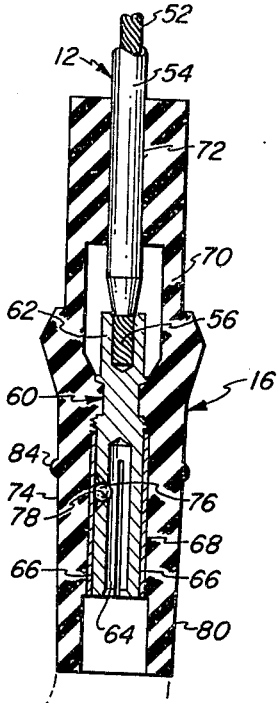
FIG. 5 is a fragmentary plan view of one end of the encapsulated trannsformer, broken away to illustrate the primary connector elements and complementary connectors.
Figure 5:
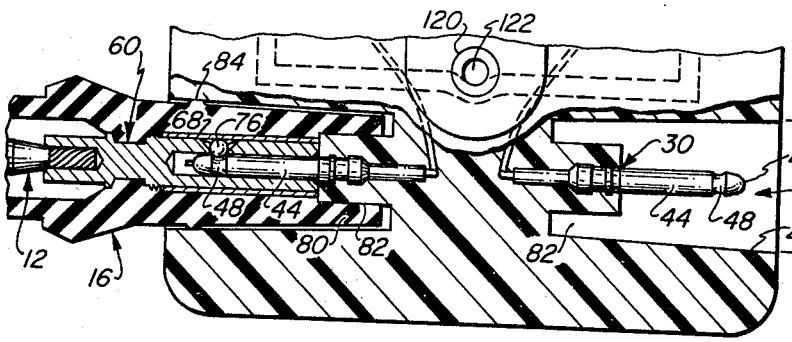

Turning now to FIG. 6, as well as to FIGS. 1 through 4, electrical connector element 32 is in the form of plug 90 which is a unitary portion of jacket 22 and is located entirely within a recess 92 so as to be protected, by the surrounding jacket, from external blows which might otherwise damage plug 90. Plug 90 includes a pair of electrical contact members in the form of sockets 94 and 96, each of which is integral with the material of jacket 22, as by molding in place. Each socket is divided into segments and is surrounded by a resilient band 95 which biases the segments inwardly and a sleeve 97 of elastomeric material to permit resilient flexure of the segments. Each socket 94 and 96 is connected to an end of the secondary windings of the core and coil assembly 20 by means of flexible leads 98.

Conductors 14 are electrically connected to pins 100 and 102 located within receptacle 18, which includes a sleeve 104 of dielectric elastomeric material surrounding the pins 100 and 102. Connection to the secondary windings is made by placing receptacle 18 over plug 90 so that pins 100 and 102 enter the respective sockets 94 and 96. The inward bias and the resilient flexure of the socket segments assures appropriate electrical contact between the pins and sockets. Upon seating of the receptacle 18 on plug 90, a skirt portion 106 of the receptacle 18 enters the recess 92 to seal the connection against dirt, water and other deleterious foreign matter. A further seal is provided by annular bead 108 located on the outer surface of skirt portion 106. Again, the integrity of the seals and the connections tends to be preserved in the installation by virtue of the stability in the dimensions of recess 92 which results from the choice of material for jacket 22.

Because of the nature of the installation, the connection between the pins 100 and 102 and the corresponding sockets 94 and 96 must withstand even greater forces tending to pull the connection open, i.e., of the order of at least 35 pounds of separation force. On the other hand, since the connection is assembled manually, connecting forces should be minimized. In order to minimize connecting forces while providing adequate resistance to separation forces, pin 102 is provided with an annular groove 110, and complementary socket 96 is provided with capturing means including a complementary detent element in the form of ball 112. Ball 112 is seated in a passage 114 which is oriented at an acute angle A to the longitudinal axis L of the socket 96. Resilient band 95 biases the ball 112 against seat 118 in passage 114. The angled orientation of passage 114 enables the resilient biasing force of band 95 on ball 112 to be more easily overcome as pin 102 is inserted than when pin 102 is withdrawn from socket 96. An angle A of about 60° yields an appropriate relationship between insertion and withdrawal forces.

As best seen in FIGS. 1 through 4, a safety feature of transformer 10 is the provision of further electrical connector elements in the form of grounding contact members 120 which are embedded in the jacket 22 and present threaded apertures 122 which can receive complementary threaded elements for the connection of grounding wires. A flexible electrical lead 124 connects each contact member 120 to the core 21 of the core and coil assembly 20. For added safety, one of the contact members 120 is connected to the secondary winding 19. Each contact member 120 is flush with the exterior surface of jacket 22 to protect the members 120 against damage.

It is noted that all of the electrical contacts 44, 94, 96 and 120 are integral with the jacket 22 and do not adversely affect the integrity of the sealed envelope provided by the jacket 22 around the core and coil assembly 20. Differences in thermal expansion and contraction between the core and coil assembly 20 and the jacket 22 are accommodated by the cushion 34. Any relative movement between the core and coil assembly 20 and the jacket 22, and consequently between the core and coil assembly and the various electrical contacts 44, 94, 96 and 120, does not affect the electrical connections between the contacts and the core and coil assembly since these connections are made via flexible electrical leads 50, 98 and 124. Thus, the encapsulated transformer 10 provides a construction which includes integral connector elements, portions of which are unitary with the encapsulating jacket, without affecting the integrity of the closed envelope provided by the jacket. The non-flexible property of the jacket material assures relatively little movement of the jacket as a result of thermal expansion and contraction, thus minimizing shifting during operation and the concomitant forces applied to the installation by such shifting. Moreover, critical dimensions at the connector elements remain essentially unchanged throughout changes in temperature, thereby minimizing any tendency to separate the connections made at the connector elements.

It is to be understood that the above detailed description of an embodiment of the invention is provided by way of example only. Various details of design and construction may be modified without departing from the true spirit and scope of the invention, as set forth in the appended claims.

The embodiments of the invention in which an exclusive property or privilege is claimed are defined as follows.

1. An encapsulated transformer having a core and coil assembly with primary and secondary windings, and having a watertight construction suitable for burial, immersion in water, an for use under a relatively wide range of temperature variations, wherein the improvement comprises:

a. a unitary jacket surrounding the core and coil assembly, for resisting rough handling, accommodating the temperature variations without fracture, and for providing the watertight encapsulation of the transformer; and b. a plurality of recesses in said jacket defining a corresponding plurality of separable external circuit connections, at least one of said external circuit connections comprising a first electrical contact member and a second complementary electrical contact member, said first contact member and said second complementary contact member each having means engageable with one another, one of said engageable means comprising a detent element adapted for engagement with the other of said engageable means, said one engageable means further including resilient means, which resilient means biases the detent element at an acute angle to the longitudinal axis of its corresponding contact member, whereby said acute angle is of sufficient magnitude to capture said other engageable means against release by a force greater than the force necessary to cause mutual engagement of said one and said other engageable means, and wherein said first contact member comprises a pin member, and said other engageable means comprises a groove on said pin member, said groove adapted to receivably engage said detent element, and said second complementary contact member comprises an electrical socket including said one engageable means, said electrical socket adapted to receivably engage said pin member.

2. The invention of claim 1, wherein said pin member is disposed within a corresponding one of said recesses and is integrally embedded in said jacket.

3. The invention of claim 1, wherein said electrical socket is disposed within a corresponding one of said recesses, said socket including a portion integrally embedded in said jacket.

4. The invention of claim 2 wherein said pin member disposed in said recess forms a receptacle adapted to receivably engage said electrical socket.

5. The invention of claim 3 wherein said electrical socket disposed in said recess forms a plug adapted to be engaged with said first contact electrical member.

6. The invention of claim 2 wherein said pin member is connected to the primary windings of said assembly.

7. The invention of claim 3 wherein said electrical socket is connected to the secondary windings of said assembly.

8. The invention of claim 1 further comprising a cushion of resilient material between said jacket and said assembly for precluding failure of said jacket associated with expansion and contraction due to said temperatuure variation.

9. The invention of claim 1 wherein said jacket comprises a thermosetting synthetic epoxy resin suitable for providing a watertight encapsulation with or without said first contact member and said second complementary contact member being electrically engaged with one another.

10. The invention of claim 1 further comprising at least one grounding electrical contact member molded integrally within said jacket.

11. The invention of claim 1 wherein a first one of said plurality of said receses defines a first of said separable connections, and a second one of said plurality of recesses defines a second of said separable connections, said first contact member of said first separable connection comprising a first pin member, said first pin member being disposed in said first one of said recesses, and wherein said second complementary contact member of said first separable connection comprises a first socket plug adapted to be receivably engaged with said first pin member, said first contact member of said second separable connection comprising a second socket plug being disposed within a second one of said recesses, and wherein said second complementary contact member of said second separable connection comprises a second pin member adapted to be receivably engaged with said second socket plug, said second pin member including said other engageable means and said second socket plug member including said one engageable means.

12. The invention of claim 11 wherein said first pin member is connected to the primary windings of said assembly, and said second socket plug is connected to the secondary windings of said assembly.

13. The invention of claim 12 wherein said connection between said first pin member and said primary windings and between said second socket plug and said secondary windings comprise flexible conductors, respectively, whereby an integrity of said jacket is maintained while expansion and contraction of said assembly is permitted without a corresponding expansion and contraction of said jacket.

* * * * *